United States Patent [19]

Hardy et al.

[11] 4,394,348

[45] Jul. 19, 1983

[54] PROCESS FOR THE PREPARATION OF ALUMINIUM ALLOYS

[75] Inventors: Francis R. F. Hardy, Chester; Martin G. Griffiths, Warrington, both of England

[73] Assignee: Interox Chemicals Ltd., London, England

[21] Appl. No.: 189,163

[22] Filed: Sep. 22, 1980

[30] Foreign Application Priority Data

Oct. 15, 1979 [GB] United Kingdom ..... 7935699

[51] Int. Cl.[3] ..... C22C 1/02

[52] U.S. Cl. ..... 420/528; 420/542; 420/546; 420/549

[58] Field of Search ..... 75/138, 148; 420/528, 420/542, 546, 549

[56] References Cited

U.S. PATENT DOCUMENTS 3,466,170 9/1969 Dunkel et al. ..... 75/148

FOREIGN PATENT DOCUMENTS 1608240 12/1970 Fed. Rep. of Germany .
2423080 11/1975 Fed. Rep. of Germany .
114051 3/1926 Switzerland .
1169104 10/1969 United Kingdom .

*Primary Examiner*—R. Dean
*Attorney, Agent, or Firm*—Larson and Taylor

[57] ABSTRACT

Strontium-modified aluminium alloys may be produced by using strontium peroxide as the source of strontium. The strontium peroxide may be mixed with molten aluminium or molten aluminium alloy in a quantity sufficient to give the desired strontium metal content in the alloy being produced. The temperature of the molten aluminium or aluminium alloy with which the strontium peroxide is mixed is preferably at least 1000° C.

The strontium peroxide alloys produced may be master alloys for use in the production of casting alloys, or may be casting alloys. Strontium acts as a grain refiner in such alloys.

14 Claims, No Drawings

PROCESS FOR THE PREPARATION OF ALUMINIUM ALLOYS

Strontium is a known component of aluminium alloys and may be used, for example, as a modifier or grain refiner in aluminium-silicon casting alloys.

Strontium metal may be included in aluminium casting alloys either directly or by way of aluminium master alloys. In either case the addition of strontium metal to molten aluminium or aluminium alloys may give rise to difficulties in practice and the high price of strontium metal makes the method expensive.

British Pat. No. 1,520,673 discloses the production of strontium-silicon-aluminium master alloys by adding a strontium-silicon alloy, containing from 15 to 60 wt % of strontium and from 40 to 75 wt % of silicon, to aluminium at a temperature of from 1540° F. (787.75° C.) to 2100° F. (1148.0° C.). The strontium-silicon alloy used may be prepared by a process disclosed in U.S. Pat. No. 3,374,086 which process involves the use of the mineral celestite having a strontium to calcium ratio of at least 10:1 as a source of strontium. The presence of calcium may give rise to the presence of undesirable calcium silicide intermetallic compounds.

There is a need in industry for a simple and economical method of producing strontium-modified aluminium alloys, whether directly produced casting alloys, or master alloys for inclusion in said casting alloys.

The present invention comprises a process for the production of a strontium-modified aluminium alloy characterised in that strontium peroxide is used as a source of strontium.

Strontium oxide tends to form a scum on the surface of molten aluminium and because of this strontium oxide and compounds which decompose to form strontium oxide such as strontium hydroxide or strontium carbonate are regarded as unsuitable for use in the formation of strontium-modified aluminium alloys. Strontium peroxide normally decomposes to form strontium oxide when heat is applied to it. However, we find that, under suitable conditions of temperature, the inclusion of strontium peroxide with aluminium may be achieved without undue scum formation problems.

Without being bound by the following theory it is believed that aluminium at suitable temperatures can act as a reducing agent. The disclosure in Tr. Inst. Met. Akad. Nauk. Gruz. SSR 12, 103-18, (1961), abstracted in Chemical Abstracts, Vol. 59, 1337e that, at a temperature in the range 1000° C. to 1200° C. aluminium, in an aluminium-silicon alloy, acts as a reducing agent is consistent with this theory. We have now found that this effect may be sufficiently marked to prevent or reduce the formation of strontium oxide.

The temperature of the aluminium is such that the reduction of strontium to the metal is achieved as evidenced by the presence of metallic strontium, suitably in the form of the intermetallic compound $SrAl_4$, on examination of the alloy formed. Preferably a temperature in the range of 1000° C. to 1300° C. is used although temperatures outside these limits, and, particularly, above 1300° C. at which sufficient strontium metal is formed to give the effect of the present invention, are not excluded. Particularly preferably, however, a temperature of at least 1050° C., for example a temperature of at least 1100° C. is used.

The strontium peroxide may be added to the aluminium or aluminium alloy while the latter is in molten form. Alternatively, the strontium peroxide may be added to powdered aluminium in the case, for example, where the alloy is to be formed by means of a thermite reaction. The addition of the strontium peroxide to the aluminium may be by simple mixing-in of the strontium peroxide in suitable powder or other particulate form. Where the strontium peroxide is included with molten aluminium or aluminium alloy, the aluminium or aluminium alloy may, or may not, initially have a sufficiently high temperature to enable the invention to be operable without raising the temperature thereof although it is preferred that the temperature of the aluminium or aluminium alloy be such that the strontium peroxide may be mixed into a melt thereof before substantial decomposition of the peroxide can occur. Preferably, the strontium peroxide is distributed throughout the aluminium or aluminium alloy by, for example, thorough mixing of a molten aluminium or aluminium alloy to which the strontium peroxide has been added, and/or by adding to a molten aluminium or aluminium alloy strontium peroxide as a number of discrete fractions simultaneously or consecutively. Suitably, the strontium peroxide may be introduced, into the body of the melt, in a number of fractions each preferably being enclosed in metal, suitably aluminium, foil.

The quantity of strontium peroxide used is dictated by the desired composition of the alloy or master alloy being produced. In a master alloy the proportion of strontium metal is preferably from 1% to 25% and, more preferably, at least 5% and up to to, for example 20% based on the total weight of the master alloy and in a casting alloy the proportion of strontium metal is preferably at least 0.005% and, more preferably, at least 0.1% and up to, for example, 2% based on the total weight of the casting alloy. In the practice of this invention equivalent quantities of strontium peroxide required to give the aforementioned proportions of strontium metal in the alloy are suitably used having regard to the degree of efficiency of inclusion of strontium under the particular conditions of e.g. temperature being used.

There may be a variation in efficiency depending on other process parameters and on the particular alloy being formed. It may be desirable therefore to use a theoretical excess of strontium peroxide of for example, at least 10% and up to not more than 40% so as to attain the desired content of strontium in the alloy being produced.

Strontium peroxide suitable for use in the practice of this invention may be produced by reaction in an aqueous medium between strontium hydroxide or strontium carbonate and hydrogen peroxide followed by dewatering and drying the suspension thereby obtained to produce a crude strontium peroxide product. The reaction may or may not go to completion and the strontium peroxide may therefore contain residual quantities of strontium hydroxide or strontium carbonate. Preferably said residual quantity is not more than 40% by weight of the crude product.

Strontium-modified aluminium alloys according to the invention may also contain other constituents, such as for example silicon or magnesium. For example, the aluminium used to form the strontium-modified alloy may initially itself be an alloy containing silicon, magnesium or other materials.

In one trial of the invention strontium peroxide manufactured by the reaction between strontium hydroxide and hydrogen peroxide and containing 63% by weight strontium peroxide was added to an aluminium melt. The melt was cast and chemical analysis of the resulting ingot revealed the presence of strontium therein. Examination indicated the presence of needles of an intermetallic strontium-aluminium compound. It was concluded that the invention had therefore been shown to be operative.

Further experiments were conducted as follows:

PRODUCTION OF THE ALLOY

In each experiment 100 g of aluminium metal was placed in a graphite crucible, in a Stanelco (Trade Mark) high frequency induction heater (20 kw model) and was heated to 1150° C. as measured by means of a thermocouple in contact with the molten aluminium. The heater coil was then switched off and a fraction of the desired quantity of strontium' compound, wrapped in a minimum quantity of aluminium foil, was placed in the molten aluminium and forced under the surface of the molten aluminium which was then stirred manually to disperse the strontium compound. The coil was then switched on again and the temperature of the molten aluminium, which had fallen slightly, raised once more to 1150° C. Further fractions of the strontium compound were added in the same manner, the coil being switched off prior to each addition and the temperature being raised once more to 1150° C. before the subsequent addition. When all of the strontium compound had been added, the temperature was maintained for 10 minutes, the coil switched off and the molten aluminium stirred. The molten aluminium was then cast into a rod shape.

EXAMINATION OF THE ALLOY

Two adjacent sections of each rod casting were taken. One section was polished and examined microscopically for its content and distribution of needle-like crystals. These crystals when present, varied in size but many were about 10 to 40 microns in length and about 1 to 4 microns wide. From electron probe microanalysis of the needles in certain samples it was determined that the Sr:Al ratio of the needles was close to 1:4 which confirmed that the needles, when present, were composed of the intermetallic compound $SrAl_4$. The other section was analysed by atomic absorption spectroscopy or where the content of strontium was too low to make this a valid technique (i.e. below 0.05% by weight) by atomic emission spectroscopy to confirm the presence of strontium metal in the casting. As a control a casting of aluminium without any addition of strontium compound was examined in like manner. A small number of platelets were visible but these were identified by electron probe microanalysis to be an iron-/aluminium compound. The following Table summarises the results of the above experiments which are numbered 1 to 7. Experiments 5 to 7 are examples of the invention. In the table "quantity %" refers to the weight % of the strontium content of the strontium compound. The compounds strontium hydroxide and strontium carbonate were used because they would be expected to convert to strontium oxide under the influence of heating. In the experiments marked * a magnesium aluminium alloy was used in place of aluminium.

TABLE

| | Strontium compound | Quantity % | Number of fractions | Strontium metal in casting % wt. | Appearance of casting |
|---|---|---|---|---|---|
| 1 | hydroxide | 2 | 3 | Nil | No $SrAL_4$ needles-appearance as for aluminium |
| 2* | hydroxide | 1.9 | 20 | Nil | |
| 3 | Carbonate | 2 | 3 | Nil | |
| 4* | Carbonate | 1.9 | 20 | Nil | |
| 5 | Peroxide | 2 | 3 | 0.84 | Even distribution of platelets consisting of $SrAl_4$ needles |
| 6 | Peroxide | 1.9 | 20 | 1.17 | Even distribution of $SrAl_4$ needles |
| 7 | Peroxide | 1.7 | 20 | 1.24 | |

We claim:

1. In a process for the production of a strontium-modified aluminium alloy which comprises admixing an aluminium-bearing material and a strontium-bearing material, said aluminium-bearing material consisting of aluminium or aluminium alloyed with at least one member selected from the group consisting of magnesium and silicon, and heating the admixed materials to form a strontium-modified aluminium alloy, the improvement wherein said strontium-bearing material comprises strontium peroxide.

2. A process according to claim 1 wherein said aluminium-bearing material consists of aluminium.

3. A process according to claim 1 wherein said aluminium-bearing material consists of a member selected from the group consisting of aluminium-silicon and aluminium-magnesium.

4. A process according to claim 3 wherein the admixed materials are heated to a temperature of at least 1000° C.

5. A process according to claim 4 wherein said temperature is at least 1050° C.

6. A method according to claim 3 wherein said admixing comprises adding strontium peroxide to a molten aluminium-bearing material.

7. A method according to claim 6 wherein a plurality of fractions of strontium peroxide are added to said molten aluminium-bearing material.

8. A method according to claim 7 wherein each fraction is wrapped in metal foil.

9. A method according claim 7 or 8 wherein the number of fractions is from 2 to 30.

10. A method according to claims 7 or 8 wherein the fractions are added successively to the melt.

11. A method according to claim 3 wherein the amount of admixed strontium-bearing material is such that the strontium content of the strontium-modified aluminium alloy product is from 0.005 to 25% by weight.

12. A process according to claim 11 wherein the strontium content is from 1 to 20% by weight.

13. A process according to claims 11 or 12 wherein the amount of admixed strontium-bearing material is in excess of the theoretical amount required to produce the strontium content of the aluminium alloy product.

14. A process according to claim 3 wherein the strontium peroxide is produced by reacting strontium hydroxide or strontium carbonate with hydrogen peroxide in an aqueous medium to produce a strontium peroxide suspension followed by dewatering and drying the strontium peroxide suspension.

* * * * *